US009376237B2

(12) United States Patent
Strauch

(10) Patent No.: US 9,376,237 B2
(45) Date of Patent: Jun. 28, 2016

(54) STORAGE DEVICE FOR TOOLS COMPRISING A PALPABLE INDICATION ELEMENT INDICATING THE ORGANIZATION-DEFINING STRUCTURAL ELEMENTS

(71) Applicant: Wera Werk Hermann Werner GmbH & Co. KG, Wuppertal (DE)

(72) Inventor: Martin Strauch, Wuppertal (DE)

(73) Assignee: Wera-Werk Hermann Werner GmbH & Co. KG, Wuppertal (DE)

( * ) Notice: Subject to any disclaimer, the term of this patent is extended or adjusted under 35 U.S.C. 154(b) by 40 days.

(21) Appl. No.: 14/220,474

(22) Filed: Mar. 20, 2014

(65) Prior Publication Data

US 2014/0202902 A1 Jul. 24, 2014

Related U.S. Application Data

(63) Continuation of application No. PCT/EP2012/069415, filed on Oct. 2, 2012.

(30) Foreign Application Priority Data

Oct. 6, 2011 (DE) ..... 10 2011 054 219

(51) Int. Cl.

| | |
|---|---|
| ***B65D 25/20*** | (2006.01) |
| ***B25H 3/00*** | (2006.01) |
| ***B25G 1/06*** | (2006.01) |
| ***B25G 1/10*** | (2006.01) |

(52) U.S. Cl.

CPC ..... *B65D 25/205* (2013.01); *B25G 1/063* (2013.01); *B25G 1/102* (2013.01); *B25H 3/00* (2013.01)

(58) Field of Classification Search

CPC ..... B65D 25/205; B25G 1/102; A61B 19/02
USPC ..... 206/349, 350, 363, 438, 564; 362/84, 362/154
See application file for complete search history.

(56) References Cited

U.S. PATENT DOCUMENTS 6,485,159 B2 * 11/2002 Pitts ..... 362/84
6,588,587 B2 7/2003 Johnson et al.

FOREIGN PATENT DOCUMENTS

| | | | |
|---|---|---|---|
| DE | 56459 | C | 2/1890 |
| DE | 9103338 | U1 | 6/1991 |
| DE | 202006012150 | U1 | 10/2006 |
| DE | 202009012145 | U1 | 12/2009 |
| FR | 989755 | A | 9/1951 |

OTHER PUBLICATIONS

International Search Report Application No. PCT/EP2012/069415 Completed: Jan. 14, 2013; Mailing Date: Jan. 22, 2013 2 pages.

* cited by examiner

*Primary Examiner* — Anthony Stashick
*Assistant Examiner* — Raven Collins
(74) *Attorney, Agent, or Firm* — Whitmyer IP Group LLC

(57) ABSTRACT

A storage device including a storage container that can be brought from a storage position in which a tool stored therein cannot be removed, to a removal position, in which the tool stored therein can be removed, with an indication element indicating the tool, the indication element being distinct from the storage container but firmly attached to the storage container and visible in the storage position. According to the invention, an indication element is provided that can be attached to the storage container in simple manner and is not only visible but also palpable, wherein the indication element is a flattened relief of the tool.

13 Claims, 4 Drawing Sheets

STORAGE DEVICE FOR TOOLS COMPRISING A PALPABLE INDICATION ELEMENT INDICATING THE ORGANIZATION-DEFINING STRUCTURAL ELEMENTS

FIELD OF THE INVENTION

The invention relates to a storage device comprising a storage container that can be brought from a storage position, in which a tool stored therein cannot be removed, into a removal position, in which the tool stored therein can be removed, with an indication element indicating the tool, said indication element being distinct from the storage container but fixedly connected to the storage container and visible in the storage position.

BACKGROUND OF THE INVENTION

DE 20 2006 012 150 U1 describes a tool box that has lower box part and an upper box part. The lower box part and the upper box part together form a storage container that can be folded back from a storage position in which screwing tools disposed therein cannot be removed, into a removal position in which the tools stored therein can be removed. In order to gain insight about the tools stored therein when the storage container is closed, the upper box part carries a label on which the tools are pictured that are stored in the storage container.

In the prior art, textile tool bags are known in which screwing tools are stored. The textile tool bags can be brought from a storage position in which the tools stored therein cannot be removed, into a removal position in which the tools stored therein can be removed. In order to give the user insight about the type of tools that is contained in the storage device in the storage position, an image of one or more of the tools contained therein is embroidered onto the textile casing that forms the storage container.

Furthermore, it is known to provide storage containers made from a rigid material with relief-like embossments that have the exact shape of tool stored in the storage device. U.S. Pat. No. 6,588,587 B2 describes a storage device lid that is provided with embossments.

DE 56 459 A1 describes a storage device for screwing tools which, in a lid of the storage container, has a window-shaped opening through which a portion of the tool stored therein protrudes outwards so that simply by palpation the type of tool stored therein can be identified.

Moreover, there are storage containers that have a window that enables to take a look into the interior of the container.

In the case of the storage device mentioned at the beginning, a label indicates the type of the tool stored in the storage device so that even in the closed state, the user is given an indication of the content of the storage device. However, under poor visibility conditions, in particular in darkness or if the suitable tool has to be searched for by blindly reaching into tool bag, the corresponding storage device cannot be found simply by palpating. This disadvantage can also be found in the case of textile tool bags on which the image of the tool is only embroidered onto the textile casing. Only in the case of such storage devices with containers, the surface of which is provided with an embossment or from which a shape-defining portion of the tool protrudes through a window, the type of the tool stored in the storage container can be determined by palpating. However, such embossments and/or tool portions protruding through a window act contrary to space-saving stowing of the storage devices since the embossments are voluminous and make it in particular difficult to stack a plurality of storage devices on top of one another.

SUMMARY OF THE INVENTION

It is an object of the invention to improve a generic storage device in such a manner that an indication element that can be secured in a simple manner on a storage container is not only visible but also palpable, the voluminous extent of the indication element being minimized.

The object is achieved by the invention specified in the claims.

In contrast to the prior art, the indication element is formed not only two-dimensional, but three-dimensional. In contrast to the storage devices where the tool protrudes through a window of the storage container, or a container wall follows the outer contour of the tool, the relief merely has a reduced height since it is flattened. The flattened relief according to the invention not only shows the outer contour of the tool stored in the storage container optically. Rather, at least the shape-defining structural elements are formed three-dimensionally raised in such a manner that they can be palpated for identifying the tool stored in the storage container. Here, the shape-defining structural elements can be disproportionate with respect to the original shape of the tool. The indication element preferably has a substantially flat mounting surface by means of which it can be secured on the surface of the storage container. It is preferably made from a different material than the storage container. The indication element side opposite from the mounting surface is structured in a three-dimensionally flattened manner. This is a palpable application that is connected to a storage container in particular for screwing tools. The tool preferably is a screwing tool, for example, a screw driver or a ratchet. The structural elements that are essential in terms of design are palpable as a result of ribs or grooves and/or differently shaped curvatures that are separated from one another. The indication element can have an elongated form, it being flatly curved transverse to the direction of extent. Haptically distinguishable structural fields that have different curvatures or haptically distinguishable indentations or elevations, in particular ribs or grooves, can alternate in the direction of extent. The connection of the indication element to the storage container can be implemented via a suitable firmly bonding, positive or nonpositive connection. If the storage container is a hard box, the indication element can be adhesively bonded thereon. An adhesive bond is also suitable for a storage container, the wall of which is flexible, thus a storage container made from a textile material. However, the indication element is preferably sewed onto a storage container that is made from a textile material. The indication element is preferably made from a soft material. This can be rubber or soft plastics. The indication element is preferably multicolored. It comprises zones of different colors. By forming grooves or ribs, said zones can be separated from one another. The individual zones can be formed by differently colored plastics or rubber components. The indication element can be produced using a multi-component injection molding method. However, casting the indication element is also possible, differently colored plastics components being successively poured into a corresponding mold. Preferably, the outer contour of the indication element has in particular a downsized shape of the outer contour of the tool stored in the storage device. The storage device can be configured such that the tool stored therein is not visible in the storage position. Nevertheless, the content of the storage device can be identified simply by palpating. Based on the weight, it can be detected whether the storage device is empty or full. In both cases, the storage container searched for can be found, for example, in a tool bag simply by palpating. Since the indication element is a flattened relief, it saves volume. Only the shape-defining structural elements of the tool need to be reproduced by the indication element. This is in particular of advantage if the tool is a screw driver or a ratchet that has a concisely identifiable, rotationally symmetric handle. The indication element merely is a flattened reproduction of this rotationally symmetric handle. The same applies to the head of a ratchet. With the flattened relief, the storage device receives an image of its content that is both, visible and palpable, and that projects only minimally beyond the outer wall of the storage container. Since the indication element is distinct from the storage container, the indication elements can be connected in different sizes, colors or types to a storage container.

BRIEF DESCRIPTION OF THE DRAWINGS

Exemplary embodiments of the invention are explained below with reference to accompanying drawings. In the figures:

FIG. 7 shows a second exemplary embodiment in which the indication element is fixedly connected to a tool box consisting of a hard material.

DETAILED DESCRIPTION OF THE INVENTION

Figure 1:
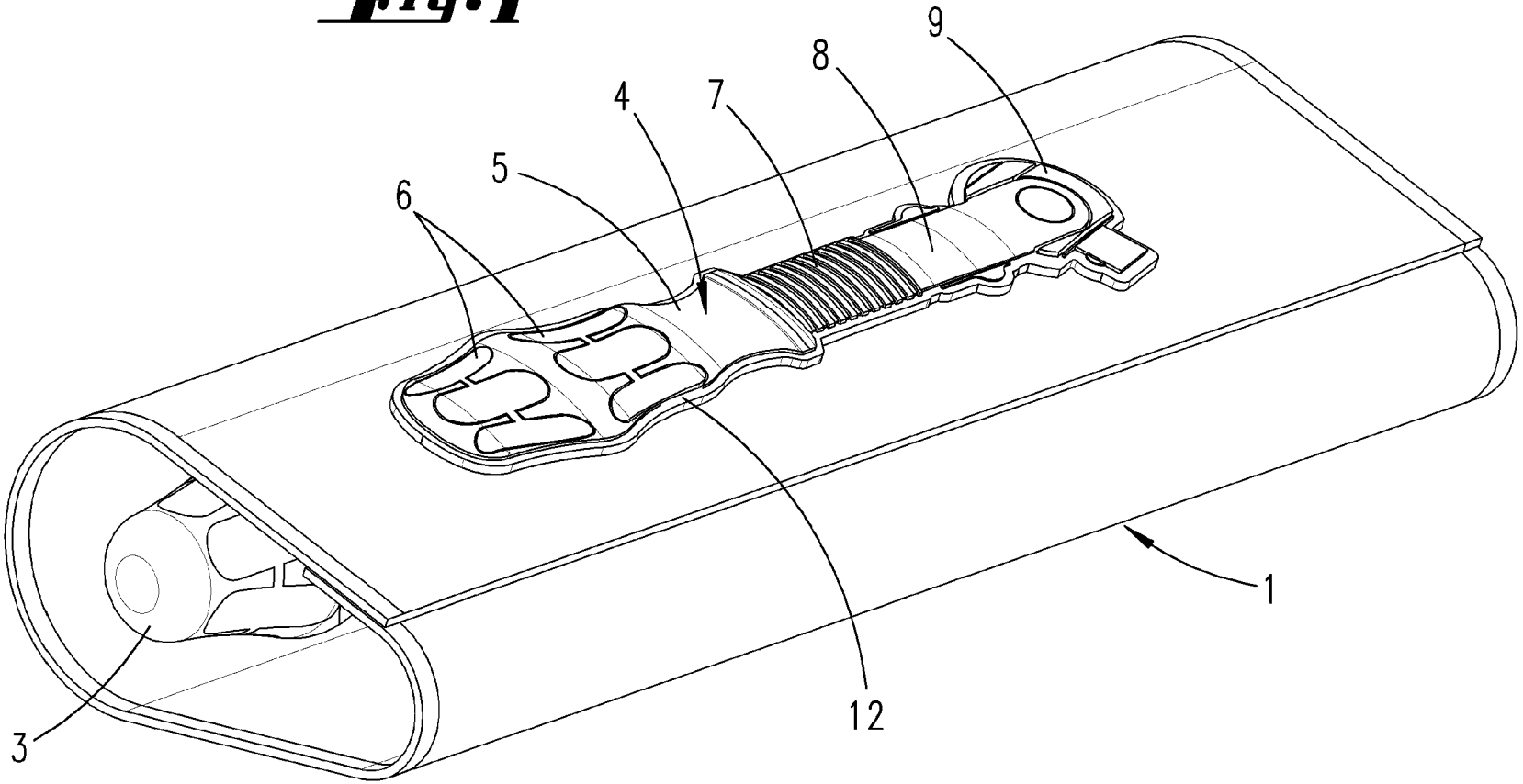
FIG. 1 shows a perspective illustration of a first exemplary embodiment in which an indication element according to the invention is attached on a textile casing.

FIG. 1 shows a perspective illustration of a textile tool bag that consists of a casing 1 formed by a fabric and in which loops and pockets are arranged in a manner known per se into which a tool 3 or accessories can be inserted. In the exemplary embodiment, the tool 3 is a ratchet that has a handle, a shank connected to the handle, and a head with an output polygon, which head is pivotably arranged at the end of the shank. In addition to the tool 3, wrench sockets that can be attached on the polygon portion of the ratchet head can also be stored in the tool bag 3.

On a visible side of the storage container formed by the textile casing 1, an indication element 4 is attached which is illustrated in detail in the FIGS. 2 to 6. The indication element 4 is an image of the tool stored in the storage container 1, in the exemplary embodiment a ratchet having a handle, a shank and a ratchet head, said image being formed as a flattened relief. It is a downsized, flattened but otherwise realistic reproduction of the tool stored in the storage container 1.

The indication element 4 consists of rubber or soft plastics and has an elongated shape. It can be seen from the FIGS. 3 to 6 that the material thickness of the indication element, compared to its longitudinal extent but also its transverse extent, is relatively small. As the FIGS. 4 to 6 show, the indication element is flatly curved in the direction transverse to its longitudinal extent. At its edges, the material thickness is less than in the center; however, the material thickness in the center is not greater than three times the material thickness at the edge.

Figure 2:
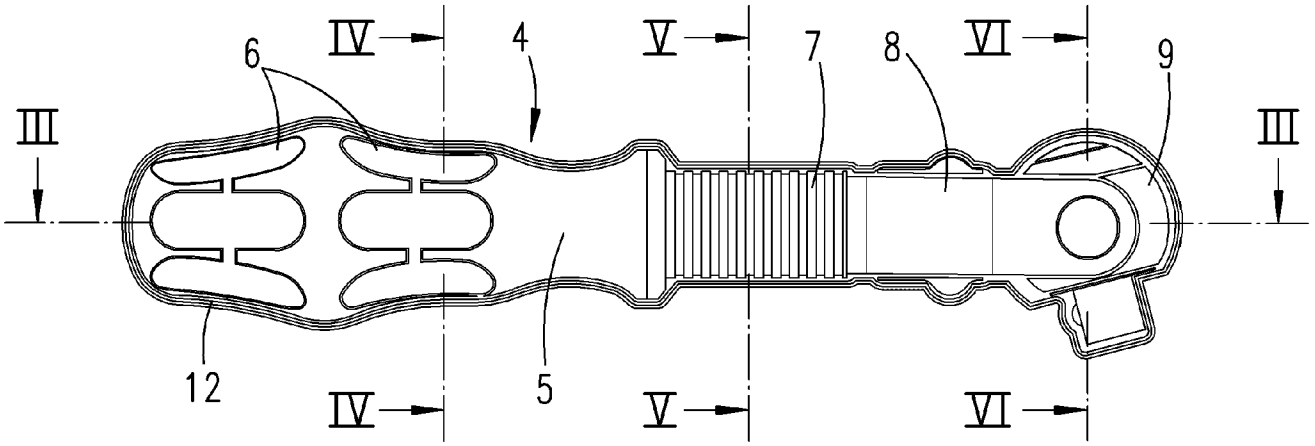
FIG. 2 shows the indication element in a top view.
Figure 3:
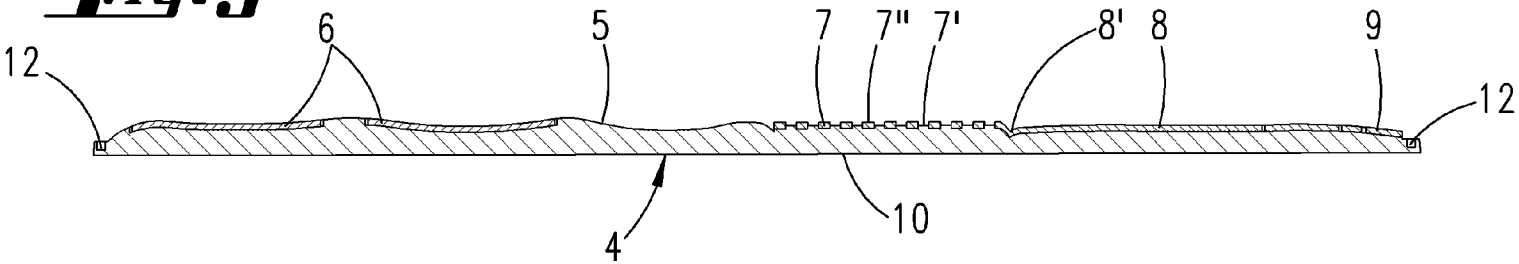
FIG. 3 shows a section according to the line III-III in FIG. 2.
Figure 4:
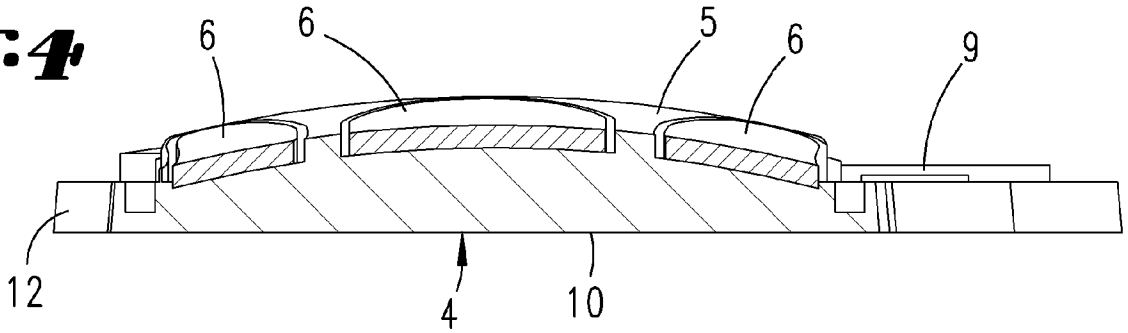
FIG. 4 shows a section according to the line IV-IV in FIG. 2.
Figure 5:
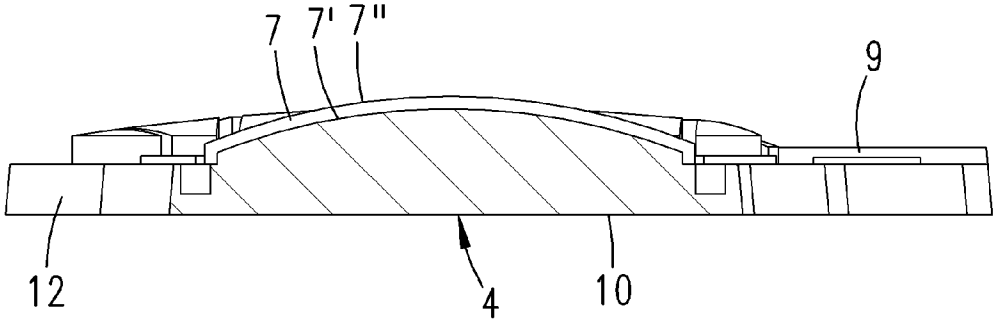
FIG. 5 shows a section according to the line V-V in FIG. 2.
Figure 6:
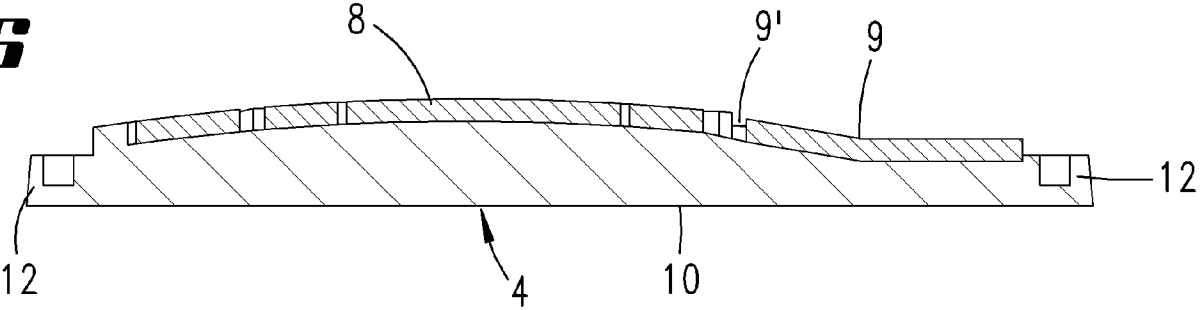
FIG. 6 shows a section according to the line VI-VI in FIG. 2.
Figure 4:
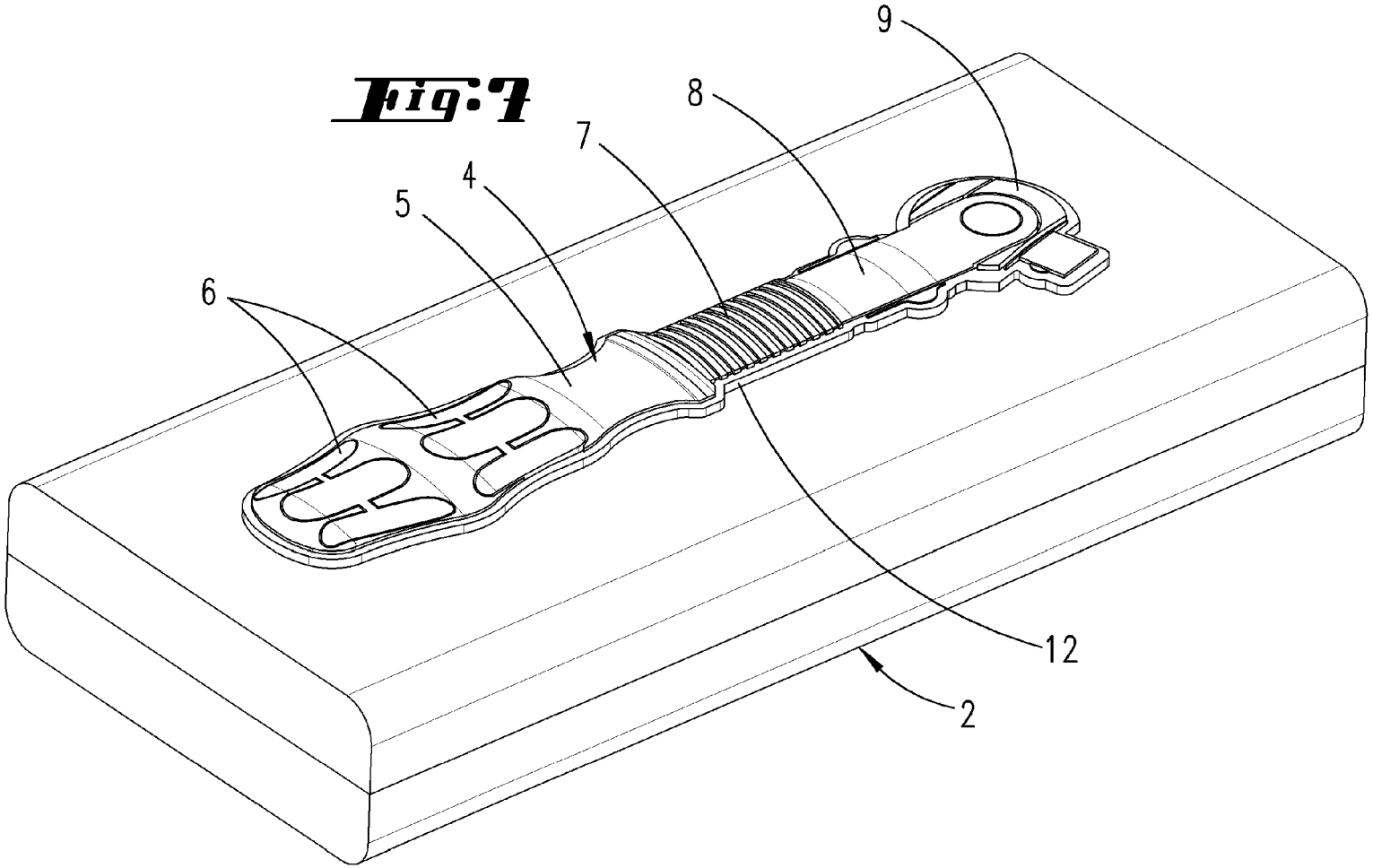

From the FIGS. 2 and 3 in combination with the FIGS. 4 to 6 it can be seen that in the direction of extent, the visible side of the indication element 4 has successive, differently haptically structured structural fields 5 to 9. The structural fields 5 to 9 are characterized by curvatures or rib/groove structures that differ from one another. The visible, structured lines in the form of grooves or ribs can be palpated with the fingertips.

The indication element 4 is formed from a basic element which is made of soft rubber or plastics and which also forms the flat underside 10 of the indication elements 4. The visible side of the indication element 4, which visible side is located opposite the flat underside 10, has structural fields 5 to 9 that can be distinguished from one another not only in terms of color but also haptically, the structural fields 6 to 9 being formed by differently colored plastic inserts in the recesses of the base body. The first structural field 5 forms a saddle-like curvature structure that is formed by the surface of the base body itself.

Two second structural fields 6 arranged spaced apart from one another in the axial direction are formed by differently colored plastic inserts, each of which have the shape of a chain of fields. Also, the second structural fields 6 are curved both in the direction of longitudinal extent and in the direction of transverse extent of the indication element 4. While they are convexly curved in the direction of transverse extent, they are concavely curved in the direction of longitudinal extent. In the exemplary embodiment, the surfaces of the second structural fields 6 merge flush into one another, but form thereby a fine groove in the surface of the base body.

A third structural field 7 is formed by grooves 7' and ribs 7" which alternate in the direction of longitudinal extent, the haptically palpable grooves 7' or grooves 7" extending in the direction of transverse extent and run there on a convex arc path.

The third structural field 7 is connected to a fourth structural field 8 having a smooth-walled palpation surface, thereby forming a notch 8' therebetween.

A fifth structural element 9 that is connected to the fourth structural element 8 is formed by a flattened image of a ratchet head with a polygon portion. Here, the structure can be palpated not only due to its outer contour, but also due to fine grooves.

The indication element 4 not only has a surface structure that can be palpated optically and haptically, but it also has a shape-defining outer contour that corresponds substantially to that of the tool 3 stored in the storage container 1. The indication element 4 is surrounded by a mounting rim 12 that provides the possibility to connect the indication element 4 to the textile casing 1 by means of a seam that runs along said mounting rim 12.

In the exemplary embodiment illustrated in FIG. 7, the flat underside 10 of the indication element 4 is adhesively bonded to the plane surface of a tool box 2.

The two storage containers 1, 2 illustrated in the FIGS. 1 and 7 are illustrated in the storage position. In the case of the storage container illustrated in FIG. 1, the tool 3 stored therein is only partially visible. In the case of the storage container 2 illustrated in FIG. 7, the tool 3 stored therein is not visible in the storage position. The storage container 1 can be opened, for example, by releasing a hook-and-loop fastener, from the storage position in a removal position, which is not illustrated here. In this removal position, the tool 3 can be removed. The storage container 2 illustrated in FIG. 7 is likewise only illustrated in the storage position. The tool box 2 has two shells that are connected to each other with a hinge about which they can be swung open into a removal position.

All features disclosed are (in themselves) pertinent to the invention. The disclosure content of the associated/accompanying priority documents (copy of the prior application) is also hereby included in full in the disclosure, including for the purpose of incorporating features of these documents in the claims in the present application. The subsidiary claims in their optional subordinated formulation characterize independent inventive refinements of the prior art, in particular to undertake divisional applications based on these claims.

REFERENCE LIST

1 Textile casing
2 Tool box
3 Tool
4 Indication element
5 First structural field
6 Second structural field
7 Third structural field
7' Grooves
7" Ribs
8 Fourth structural field
8' Notch
9 Fifth structural field
10 Flat underside
11 Groove
12 Mounting rim

What is claimed is:

1. A storage device comprising a storage container that is adjustable from a storage position in which a tool stored therein cannot be removed, into a removal position in which the tool stored therein can be removed, with an indication element indicating the tool, said indication element being distinct from the storage container but fixedly connected to the storage container and visible in the storage position, wherein the indication element is a relief of the tool;

the indication element comprises a visible surface that is curved relative to a mounting surface of the indication element, the visible surface having a plurality of haptically distinguishable structural fields;

the structural fields that form the visible surface of the indication element comprise at least one of curvatures concavely curved in towards the mounting surface, curvatures convexly curved away from the mounting surface, outer contours, or arrangements of ribs and grooves that are distinct from one another; and the indication element that has a flat underside is adhesively bonded or sewed to the storage container.

2. The storage device according to claim 1, wherein the indication element is connected to the storage container in a positive-locking, firmly bonding, or nonpositive-locking manner.

3. The storage device according to claim 1, wherein the storage container consists of a resiliently flexible material, in particular of a textile.

4. The storage device according to claim 1, wherein the indication element consists of a resiliently flexible material, in particular of rubber or soft plastics.

5. The storage device according to claim 1, wherein the indication element is multi-colored, the individual color components being formed from rubber or plastics zones that are distinct from one another.

6. The storage device according to claim 1, wherein visible structural lines in a visible surface of the indication element are formed as grooves or ribs that have such a depth/height that their course can be palpated.

7. A storage device comprising a storage container that is adjustable from a storage position in which a tool stored therein cannot be removed, into a removal position in which the tool stored therein can be removed, with an indication element indicating the tool, said indication element being distinct from the storage container but fixedly connected to the storage container and visible in the storage position, wherein the indication element is a relief of the tool;

the indication element comprises a visible surface that is curved relative to a mounting surface of the indication element, the visible surface having a change in curvature relative to the mounting surface and having a plurality of haptically distinguishable structural fields; and the indication element that has a flat underside is adhesively bonded or sewed to the storage container.

8. The storage device according to claim 7, wherein the structural fields that form the visible surface of the indication element comprise at least one of curvatures concavely curved in towards the mounting surface, curvatures convexly curved away from the mounting surface, outer contours, or arrangements of ribs and grooves that are distinct from one another.

9. The storage device according to claim 7, wherein the indication element is connected to the storage container in a positive-locking, firmly bonding, or nonpositive-locking manner.

10. The storage device according to claim 7, wherein the storage container consists of a resiliently flexible material, in particular of a textile.

11. The storage device according to claim 7, wherein the indication element consists of a resiliently flexible material, in particular of rubber or soft plastics.

12. The storage device according to claim 7, wherein the indication element is multi-colored, the individual color components being formed from rubber or plastics zones that are distinct from one another.

13. The storage device according to claim 7, wherein visible structural lines in a visible surface of the indication element are formed as grooves or ribs that have such a depth/height that their course can be palpated.

* * * * *